US008662846B2

(12) United States Patent
Natarajan

(10) Patent No.: US 8,662,846 B2
(45) Date of Patent: Mar. 4, 2014

(54) BIDIRECTIONAL FAN HAVING SELF-ADJUSTING VANE

(75) Inventor: Subbiah Natarajan, Secunderabad (IN)

(73) Assignee: General Electric Company, Schenectady, NY (US)

( * ) Notice: Subject to any disclaimer, the term of this patent is extended or adjusted under 35 U.S.C. 154(b) by 628 days.

(21) Appl. No.: 12/881,308

(22) Filed: Sep. 14, 2010

(65) Prior Publication Data

US 2012/0063892 A1 Mar. 15, 2012

(51) Int. Cl.
*B63H 1/06* (2006.01)
*B63H 5/125* (2006.01)

(52) U.S. Cl.
USPC ..... 416/131; 416/185; 415/911

(58) Field of Classification Search
USPC ..... 415/911; 416/131, 142, 143, 182, 185, 416/187, 205, 167, 168 R
See application file for complete search history.

(56) References Cited

U.S. PATENT DOCUMENTS

| | | | | |
|---|---|---|---|---|
| 3,860,361 | A | 1/1975 | McMurtry et al. | |
| 3,932,054 | A | 1/1976 | McKelvey | |
| 4,412,783 | A | 11/1983 | Barlass | |
| 4,515,511 | A * | 5/1985 | Heerlein | 416/131 |
| 4,662,819 | A | 5/1987 | Lakowske et al. | |
| 5,800,058 | A * | 9/1998 | Cook | 366/306 |
| 6,382,910 | B1 * | 5/2002 | Kato et al. | 415/150 |
| 6,699,013 | B2 | 3/2004 | Zweighaft et al. | |
| 7,270,512 | B2 * | 9/2007 | Sullivan et al. | 415/199.5 |
| 2002/0176774 | A1 * | 11/2002 | Zinsmeyer et al. | 415/150 |
| 2006/0078423 | A1 | 4/2006 | Zheng | |

FOREIGN PATENT DOCUMENTS

EP 2149712 A1 * 2/2010

* cited by examiner

*Primary Examiner* — Edward Look
*Assistant Examiner* — Christopher J Hargitt
(74) *Attorney, Agent, or Firm* — Hoffman Warnick LLC

(57) ABSTRACT

A bidirectional centrifugal fan having a self-adjusting vane. In one embodiment, the fan includes a driving disc having a pivot pin extending therefrom; a vane pivotably attached to the pivot pin, the vane including an aperture extending at least partially therethrough; and a trailing disc including a guide arm for receiving the aperture of the vane.

17 Claims, 8 Drawing Sheets

BIDIRECTIONAL FAN HAVING SELF-ADJUSTING VANE

BACKGROUND OF THE INVENTION

The subject matter disclosed herein relates to a bidirectional fan system. More specifically, the subject matter disclosed herein relates to a bidirectional centrifugal fan having at least one self-adjusting vane.

Existing fans (e.g., centrifugal fans) in bidirectional motors have radial vanes (or, blades), these radial vanes providing for flow of air in one direction based upon the direction of rotation of the fan. In order to provide airflow in the same direction despite different directions of rotation (such as when the bidirectional fan is rotated in either the clockwise or anticlockwise direction), the vanes are either affixed without incline in a radially outward orientation, or the vanes are fixed in an inclined orientation, and must be adjusted or remounted manually. The non-inclined orientation may cause the fan to operate inefficiently, and may cause noise. The inclined orientations, which require manual adjustment in order to operate effectively for a particular direction of rotation, may cause time and manpower to be wasted.

BRIEF DESCRIPTION OF THE INVENTION

A bidirectional centrifugal fan having a self-adjusting vane is disclosed. In one embodiment, the fan includes a driving disc having a pivot pin extending therefrom; a vane pivotably attached to the pivot pin, the vane including an aperture extending at least partially therethrough; and a trailing disc including a guide arm for receiving the aperture of the vane.

A first aspect of the disclosure provides a bi-directional centrifugal fan including: a driving disc having a pivot pin extending therefrom; a vane pivotably attached to the pivot pin, the vane including an aperture extending at least partially therethrough; and a trailing disc including a guide arm for receiving the aperture of the vane.

A second aspect of the disclosure provides an apparatus comprising: a motor; and a bidirectional fan operably connected to the motor, the bidirectional fan including: a driving disc including a pivot pin extending therefrom; a vane pivotably attached to the pivot pin, the vane including an aperture extending at least partially therethrough; and a trailing disc including a guide arm for receiving the aperture of the vane, the guide arm configured to move along a length of the aperture.

A third aspect of the disclosure provides a bi-directional centrifugal fan including: a driving disc having a plurality of pivot pins extending therefrom; a plurality of vanes each pivotably attached to one of the plurality of pivot pins, each of the plurality of vanes including a slot extending along a primary axis of the vane and at least partially therethrough along a secondary axis of the vane; and a trailing disc including: a guide arm for receiving the slot of the vane, the guide arm configured to move within the slot along the primary axis of the vane.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

It is noted that the drawings of the invention may not be to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

As indicated above, aspects of the invention provide for a bidirectional centrifugal fan having a self-adjusting vane. The vane is configured to self-adjust when the direction of motion of the fan is changed from clockwise to anticlockwise, and vice versa. That is, intervention by an operator, e.g., a human operator and/or a mechanical or robotic tool, is unnecessary to adjust the position of the vane in response to a change in the direction of motion of the fan. As used herein, the term "fan" includes devices used for accelerating a fluid. For example, the device may include an impeller used to accelerate a fluid (e.g., water). While the example of a fan is predominately described herein, it is understood that the teachings of this disclosure may apply to impellers, pumps or other flow creating devices as well.

Figure 1:
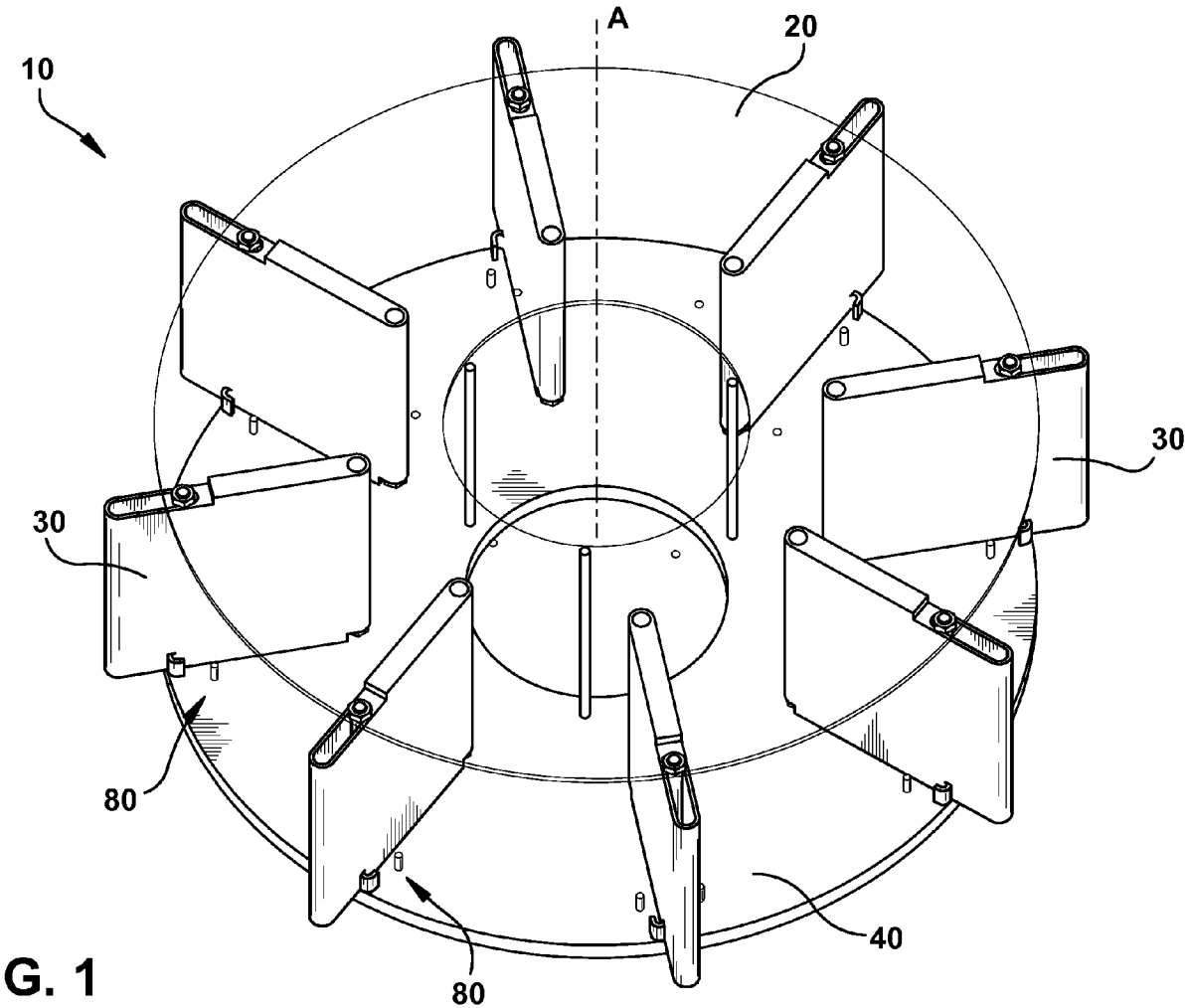
FIG. 1 shows a schematic plan view of a bidirectional fan according to an embodiment.

Turning to FIG. 1, a three-dimensional perspective view of a bidirectional fan 10 is shown according to an embodiment. In this case, bidirectional fan 10 includes a centrifugal fan. As is known in the art, centrifugal fans may be used to accelerate a gas, and may be operably attached to a motor or other rotating device (e.g., motor 200 of FIG. 10). Centrifugal fans intake gas through a center region of the fan, and accelerate that gas before it exits at an angle normal to the intake angle (due to the centrifugal force caused by rotation of the fan vanes). As is also known in the art, bidirectional fans are fans capable of rotating in both clockwise and anticlockwise directions. In this case, bidirectional fan 10 is shown in a substantially neutral position (where vanes are neither forward leaning nor backward leaning). As shown, bidirectional fan 10 may include a driving disc 20 (shown as partially transparent for illustrative purposes), at least one vane 30, and a trailing disc 40. Interaction of these components will be further described herein.

Figure 2:
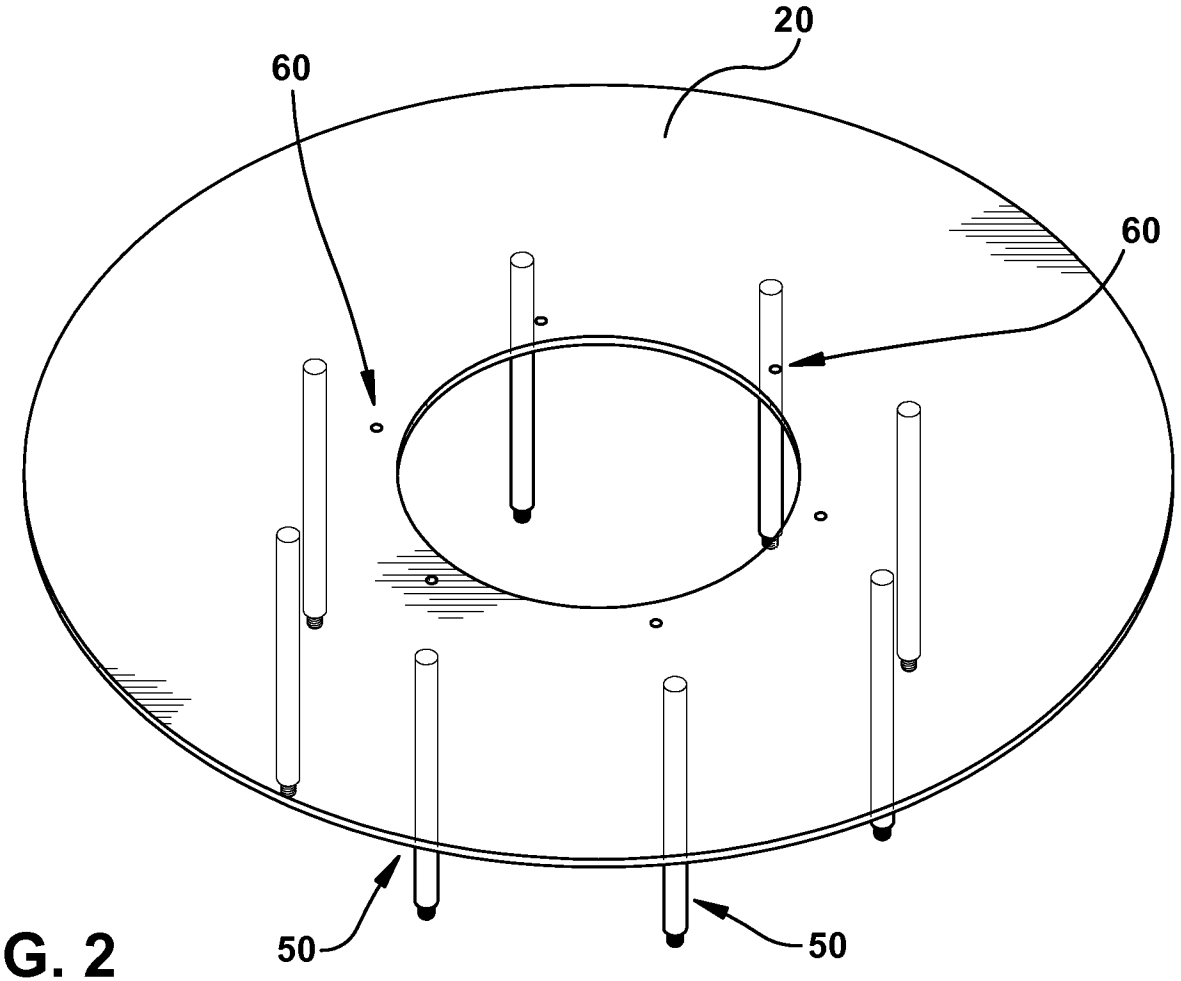
FIGS. 2-4 show schematic plan views of components in a bidirectional fan according to embodiments.

Turning briefly to FIG. 2, a three-dimensional perspective view of driving disc 20 is shown according to an embodiment. In FIG. 2, driving disc 20 of FIG. 1 is shown (as partially transparent), the driving disc 20 having pivot pin(s) 50 extending therefrom. Pivot pins 50 may extend substantially perpendicularly from driving disc 20, and may be formed of any conventional material used in bidirectional fans, e.g., steel aluminum, composite(s), etc. Pivot pins 50 may allow for pivotable attachment of one or more vanes (FIG. 1, element number 30), and therefore may take any shape (e.g., rod-shaped, elongated spherical, etc.) capable of allowing vane 30 to pivot about pivot pin 50. An end of one or more pivot pins 50 may be configured to receive a stopper (e.g., a nut, pin, fastener, etc.), the stopper restricting movement of the vane 30 along an axis of rotation of the driving disc 20. In one embodiment, an end portion of pivot pin 50 is machined in such a way that it may receive the stopper, for example, it may be threaded or otherwise truncated or pierced in order to receive a nut, pin, fastener, etc. Driving disc 20 is also shown including apertures 60, which may be used for connecting to a driving member (e.g., a shaft) of a motor (not shown), via, e.g., screws, nuts, bolts, fasteners, etc.

Figure 3:
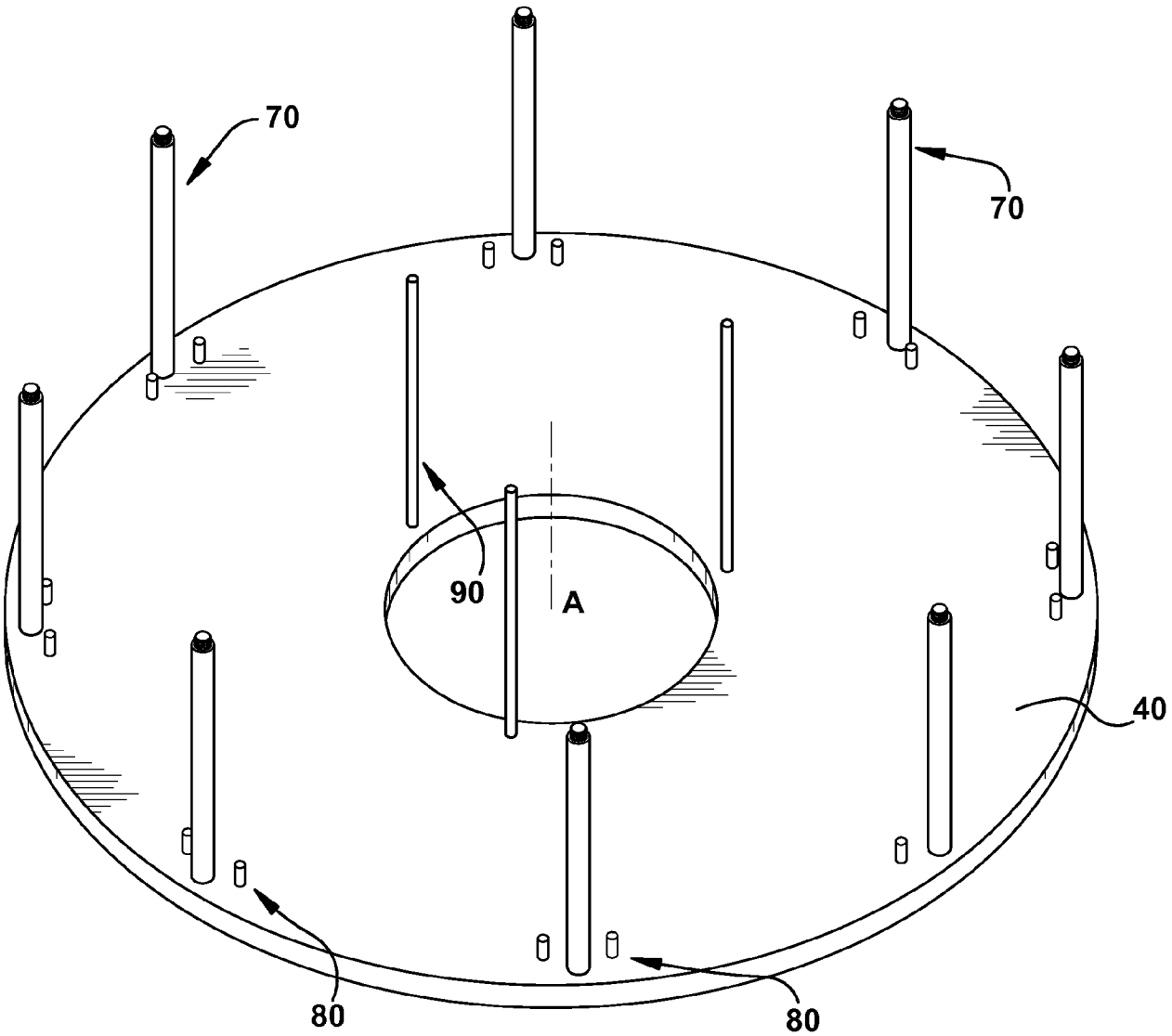

Turning to FIG. 3, a three-dimensional perspective view of a trailing disc 40 is shown according to an embodiment. As is described further herein, trailing disc 40 may have a greater weight than driving disc 20, which may allow for a slight lag in rotation of trailing disc 40 with respect to driving disc 20 during operation of bidirectional fan 10. Trailing disc 40 is shown further including a plurality of guide arms 70, each for receiving an aperture (not shown) of a vane 30 (FIG. 1). Guide arm 70 and trailing disc 40 may be formed of any conventional material used in bidirectional fans. It is understood that guide arm 70 may be attached to trailing disc 40 in any conventional manner, and may be cast out of a continuous piece of material (e.g., a metal) or otherwise affixed (e.g., via welding or fastening) to trailing disc 40. Guide arm 70 may extend substantially perpendicularly from a surface of trailing disc 40. Also shown in FIG. 3 are stoppers 80, cast with, affixed to, or otherwise attached to the surface of trailing disc 40, and located adjacent guide arm 70. In one embodiment, as shown, a pair of stoppers 80 may be affixed to trailing disc 40, one on either side of each guide arm 70 along a circumference of trailing disc 40. In one embodiment, stoppers 80 may be located radially inward of guide arm 70 with respect to a central (rotational) axis (A) of trailing disc 40. In one embodiment, stoppers 80 are equally spaced from guide arm 70 on opposing sides of the guide arm 70.

Also shown in FIG. 3 are support arms 90, which may be used to provide radial support between trailing disc 40 and driving disc 20 (FIG. 1) during operation of bidirectional fan 10. Support arms 90 may be affixed or otherwise attached (e.g., via welding, casting, etc.) to trailing disc 40, and may be formed of any conventional material used in bidirectional fans (e.g., one or more composites, or a metal such as steel or aluminum). As is described further herein, support arms 90 may be positioned on trailing disc 40 with clearance provided between outer surfaces of support arms 90 and an inner diameter of driving disc 20 (FIG. 1). In one embodiment, support arms 90 may be configured to provide radial clearance between an inner diameter (radially inner surface) of driving disc 20 an outer surface of all but one support arm 90. In this case, only one support arm 90 may contact the inner surface of driving disc 20 at any moment of operation of bidirectional fan 10. This may allow for sufficient radial support between driving disc 20 and trailing disc 40, while reducing frictional forces between driving disc 20 and trailing disc 40. In an alternative embodiment, anti-friction bearings or bushings may be used in place of or in conjunction with support arm 90 to provide radial support between driving disc 20 and trailing disc 40, while reducing frictional forces between driving disc 20 and trailing disc 40.

Figure 6:
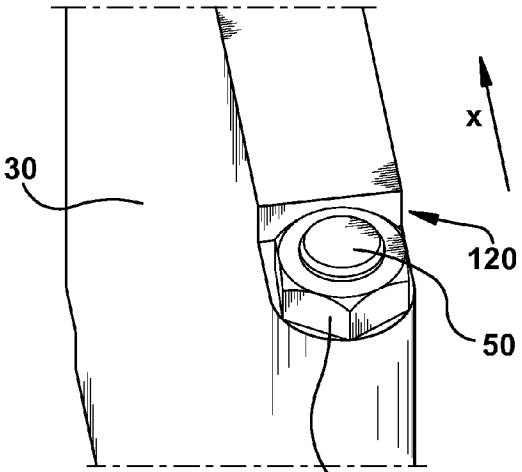
FIG. 6 shows a schematic plan view of components in a bidirectional fan according to embodiments.
Figure 5:
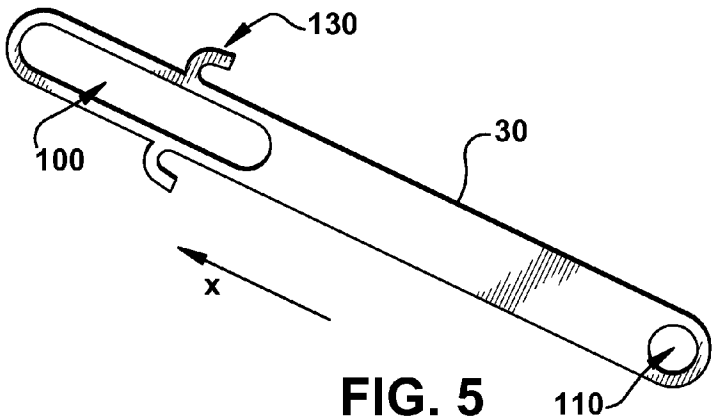
FIG. 5 shows a top view of a vane according to an embodiment.
Figure 4:
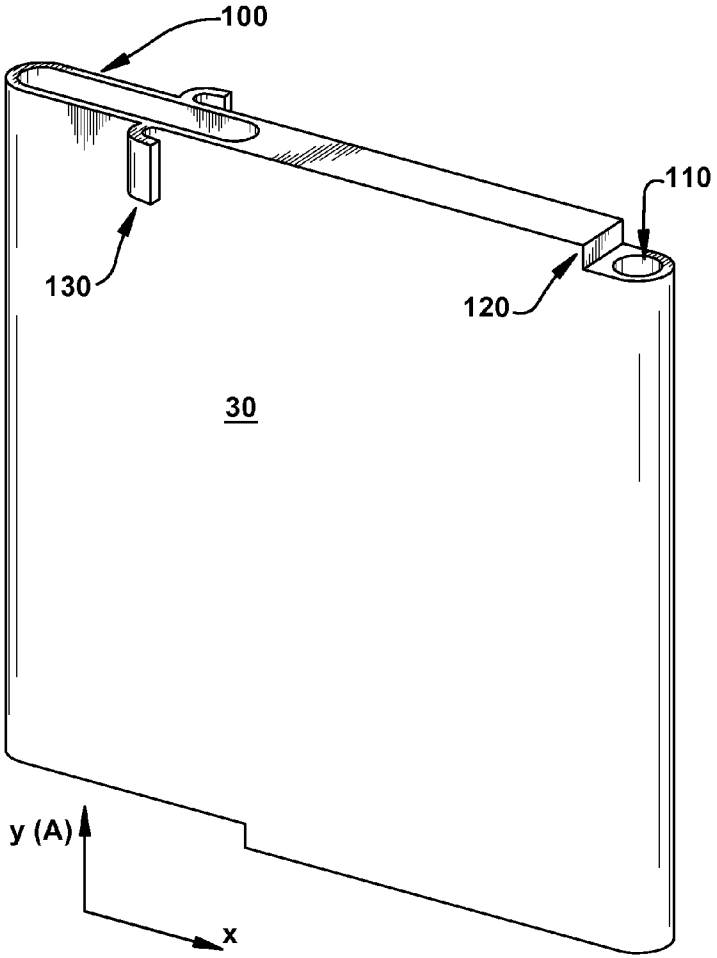

Turning to FIGS. 4-6, a first three dimensional perspective view of a vane 30, a second three dimensional perspective view of a vane 30, and a top view of vane 30 are shown, respectively. Vane 30 is shown including an aperture 100 extending at least partially therethrough. In one embodiment, aperture 100 may extend along an entire height (along y-axis) of vane 30, and may be configured to receive guide arm 70 (FIGS. 1, 3). Aperture 100 may further extend along at least a portion of the length (along x-axis) of vane 30, and may allow for movement of vane 30 with respect to guide arm 70 positioned therein (FIG. 1). In one embodiment, vane 30 is configured to move with respect to guide arm 70 (FIGS. 1, 3) along a primary axis of the vane 30 (primary axis denoted by x-axis). In one embodiment, aperture 100 may be a substantially oblong circular slot, extending completely through vane 30 in only one direction (axial direction, A). Vane 30 may also include a second aperture 110, configured to pivotably attach vane 30 to pivot pin 50 (FIGS. 1-2, 6). Similarly to aperture 100, second aperture 110 may extend substantially through vane 30 along one direction (A-axis). However, in alternative embodiments, second aperture 110 and first aperture 100 may be configured to extend only partially through vane 30 (not shown). In any case, second aperture 110 may allow vane 30 to pivotably attach to pivot pin 50, such that vane 30 may rotate about the primary axis of pivot pin 50 (primary axis of pivot pin 50 being parallel with the A-axis in FIG. 4). This may allow for movement of vane 30 from a clockwise-leaning to an anti-clockwise-leaning position, and vice versa, within bidirectional fan 10. In one embodiment, second aperture 110 may be positioned adjacent to a shoulder 120 (or, shelf, or other contour) that may allow for pivot pin 50 to be securely attached to vane 30, via, e.g., a nut, pin, or other fastener 52. Shelf 120 may allow for the secure attachment of vane to pivot pin 50 without disrupting the clearance between vane 30 and driving disc 20.

Vane 30 may further include one or more protrusion(s) 130 extending therefrom, each protrusion 130 configured to engage one of the stoppers 80 (FIG. 1, 3) attached to trailing disc 40. In one embodiment, protrusion 130 may include a guideway configured to engage a stopper 80 by at least partially surrounding the stopper 80. In this case, protrusion 130 may take the form of a hook or other multi-sided extension capable of contacting stopper 80 at more than one circumferential location. However, as is described further herein, protrusion 130 may be configured as any shape that engages stopper 80 in response to a lag in rotation of trailing disc 40 with respect to driving disc 20.

Figure 7:
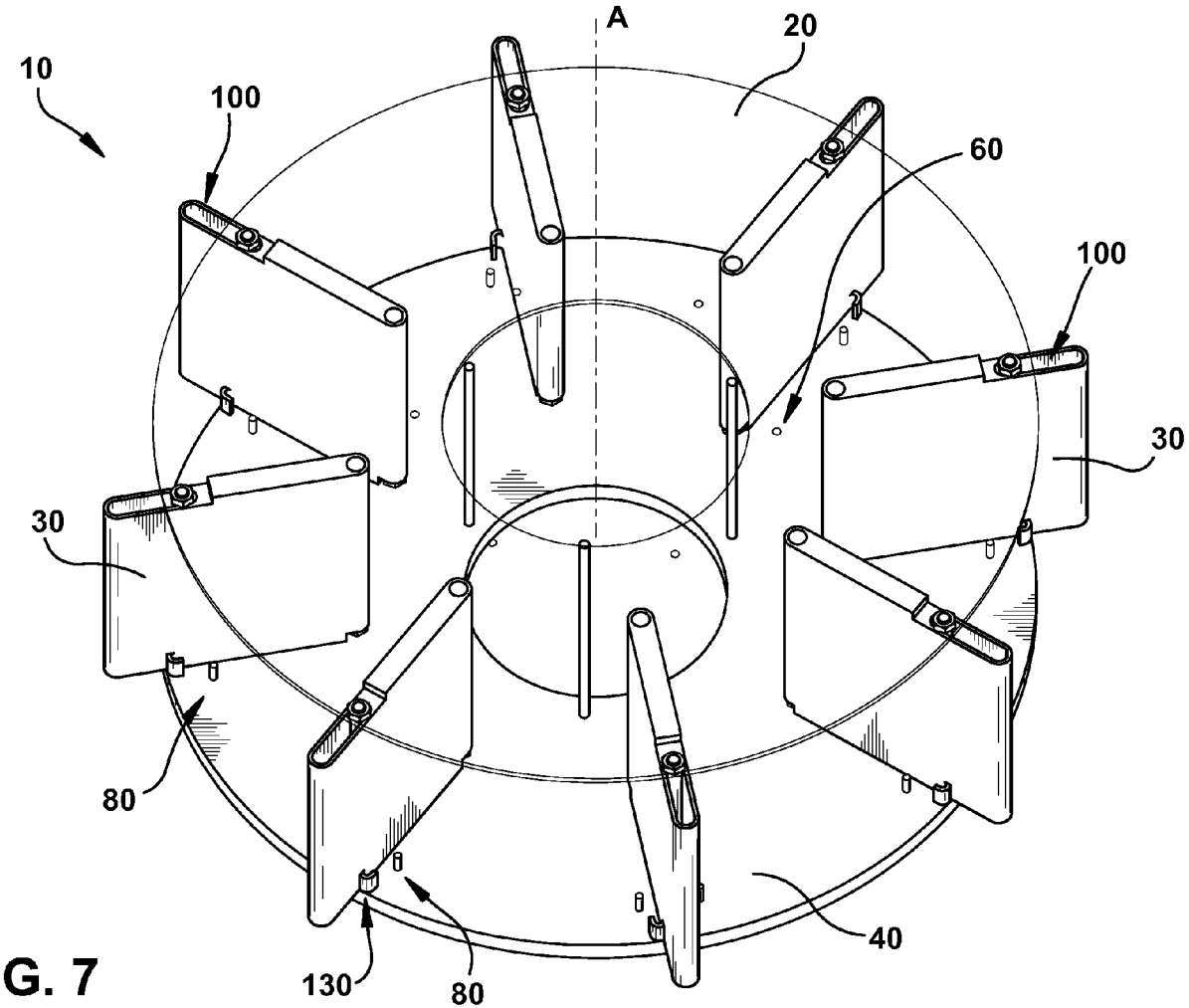
FIGS. 7-9 show schematic plan views of a bidirectional fan according to embodiments.

Operation of bidirectional fan 10 will now be described with reference to the following figures. Turning to FIG. 7, a three-dimensional perspective view of bidirectional fan 10 in a neutral position (neither clockwise-leaning nor anti-clockwise-leaning vanes 30) is shown. In this position, vanes 30 are neither forward-leaning nor backward-leaning. That is, the radial ends of vanes 30 are at approximately their greatest radial distance from the central (rotational) axis (A) of bidirectional fan 10. In this position, a space exits between protrusions 130 (e.g., guideways) and stoppers 80, such that protrusions 130 do not engage stoppers 80. In this position, driving disc 20 has yet to initiate rotational motion about axis (A), and a portion of aperture 100 is radially outward (extending beyond) of an outer circumference of trailing disc 40.

Figure 8:
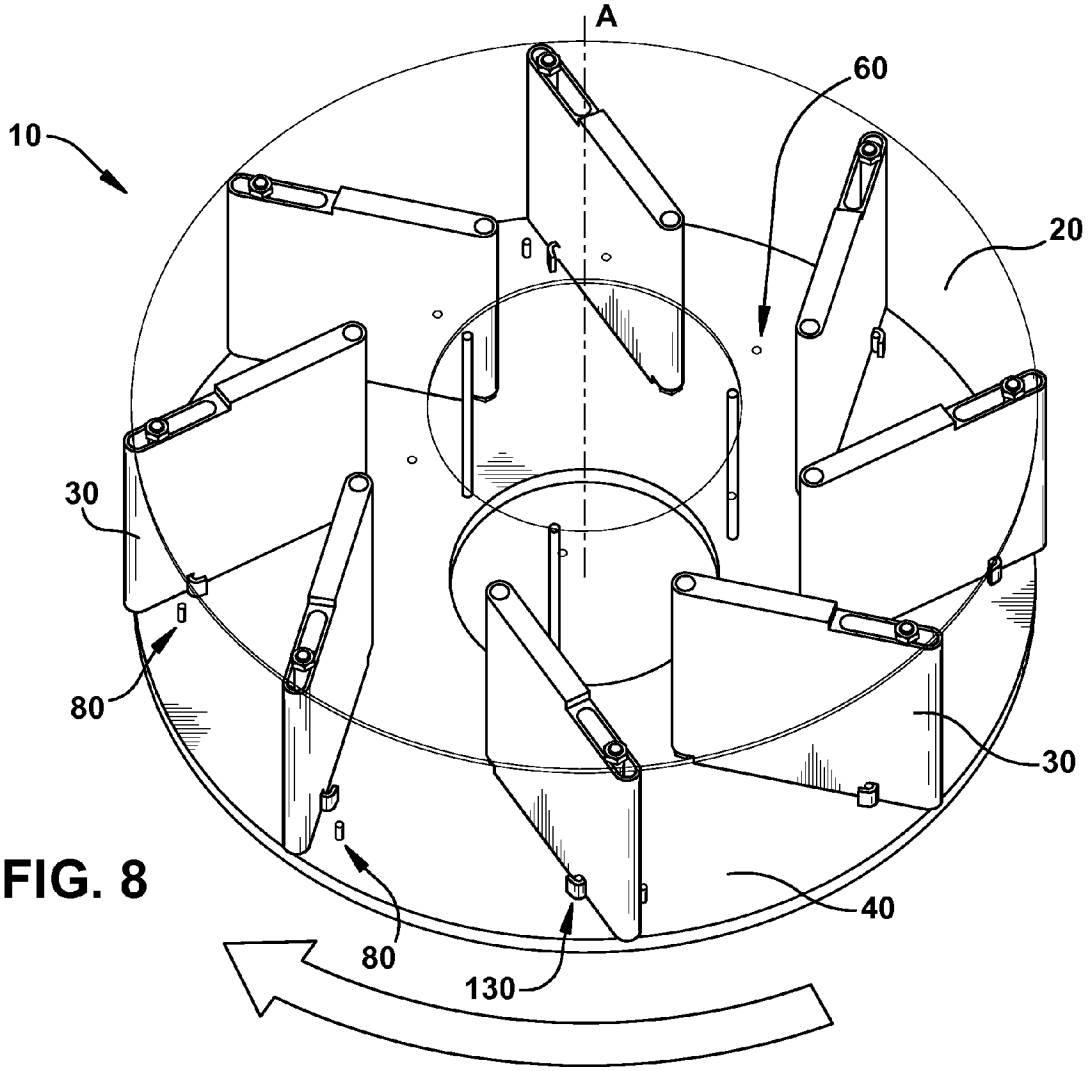

Turning to FIG. 8, a three-dimensional perspective view of bidirectional fan 10 is shown after rotation of driving disc 20 in a clockwise direction (indicated by arrow). As described herein, driving disc 20 may be lighter (in weight) than trailing disc 40, such that when driving disc 20 is first rotated from a neutral position or any other inclined-vane position, by a drive shaft (FIG. 10, numeral 230, attached via apertures 60), trailing disc 40 does not immediately follow. As vanes 30 are pivotably attached to the pivot pins 60 of driving disc 20, the radially inward portions of vanes 30 are rotated along with driving disc 20. The radially inward portions of vanes 30 rotate ahead of the radially outward portions of vanes 60 (e.g., near aperture 100), thereby producing a "leaning" vane 30. This leaning position of vane 30 may be secured by, e.g., the stopper 80 and protrusion 130. That is, during rotation of driving disc 20, but before substantial rotation of trailing disc 40, a protrusion 130 of vane 30 may engage (contact and/or rest upon) a stopper 80. In one embodiment, one protrusion 130 of each vane 30 may engage a stopper 80 located toward the direction of rotation of the driving disc 20. That is, in one embodiment, a protrusion 130 on the leading edge of vane 30 will engage with a stopper 80 located on the side of that leading edge. After protrusion 130 engages with stopper 80, vane 30 may act as a connecting mechanism between driving disc 20 and trailing disc 40. More specifically, after engagement of protrusion 130 with stopper 80, trailing disc 40 may move in step with driving disc 20 in the clockwise rotation (such that trailing disc 40 is no longer trailing). This may allow bidirectional fan 10 to rotate about its central axis (A) in the clockwise direction, while keeping vanes 30 secure in an anti-clockwise-leaning direction.

As is understood by the teachings herein, it is possible to vary the angle of inclination of one or more vanes 30 by modifying: a position of protrusion 130 along the primary axis (x) of vane 30, a position of stopper 80 in the radial and/or circumferential directions, a size of aperture 100 (e.g., along primary axis (x) or along circumferential direction), or a position of guide arm 70 (either along axial direction or circumferential direction of trailing disc 40). It is further understood that the angle of inclination of one or more vanes 30 may be varied by dynamically modifying the position of stopper 80. That is, trailing disc 40 may be configured with a number of apertures for which to insert a stopper 80. Stopper 80 may be moved (e.g., by an operator during fan assembly/manufacture) from one aperture to another to vary the angle of inclination of a vane 30 during operation of the bidirectional fan 10.

Figure 9:
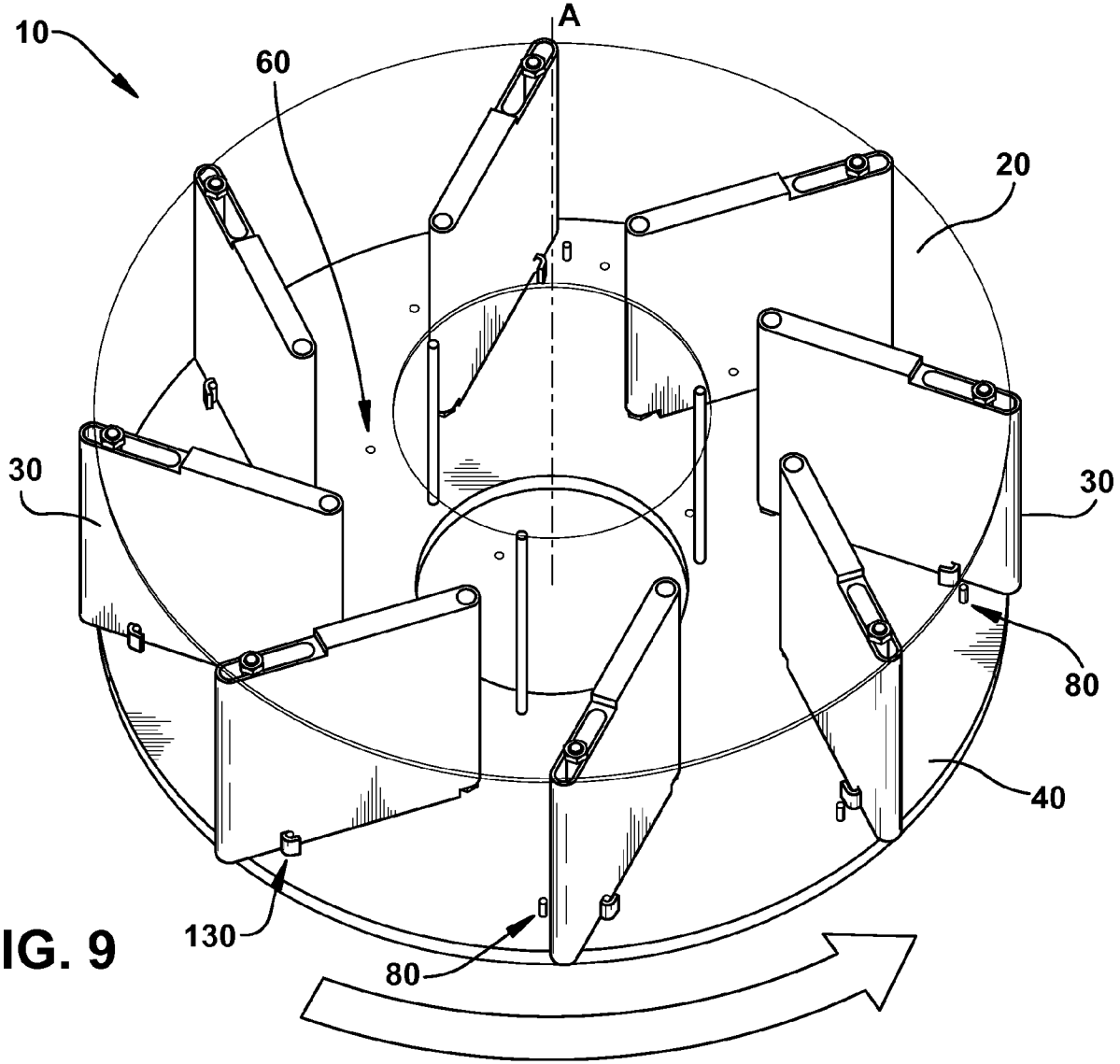

Turning to FIG. 9, the bidirectional fan 10 of FIGS. 7-8 is shown during rotation in the anti-clockwise direction. In this case, a similar process may be executed as explained with reference to FIG. 8, except in this case the driving disc 20 may begin its rotation from a neutral position (FIG. 7) in the anti-clockwise direction. As described herein, driving disc 20 may be lighter (in weight) than trailing disc 40, such that when driving disc 20 is first rotated from a neutral position or any inclined-vane position by a drive shaft (FIG. 10, numeral 230, attached via apertures 60), trailing disc 40 does not immediately follow. This applies to both clockwise and anti-clockwise rotation of driving disc 20 from the neutral position. In the case shown in FIG. 8, after protrusion 130 engages stopper 80, trailing disc 40 may follow in step with driving disc 20. However, the lag in rotation between the driving disc 20 and trailing disc 40 allows for the vanes 30 to pivot about pivot pins 50 and alter their orientation (or lean). As in the case described with reference to FIG. 8, protrusion 130 on the leading edge of vane 30 may engage stopper 80 the stopper on that side of vane 30.

It is understood that while protrusion 130 on the leading edge of vane 30 is shown as engaging stopper 80, it is also possible that protrusion 130 on the trailing edge of vane 30 could be configured to engage a stopper 80 on that side of vane 30. For example, in one embodiment, stopper 80 may be located radially closer to axis A than shown herein. In this case, a protrusion 130 on the trailing edge of vane 30 may engage a stopper on that side of vane 30.

In an alternative embodiment, stopper 80 and protrusion 130 are not required to engage vanes 30 in a particular orientation (clockwise leaning or anti-clockwise leaning). In this case, the length of aperture 100 (FIGS. 4-5) along the primary axis (x) of vane 30 may be modified to control how far vanes 30 may lean when leading disc 20 rotates with respect to trailing disc 40 (producing the lag described herein). In this case, the length of aperture 100 along the primary axis (x) may be such that an inner surface of the radially outward portion of aperture 100 engages guide arm 70 after rotation of leading disc 20 with respect to trailing disc 40. This allows the inner surface of aperture 100 to pull trailing disc 40, via contact with guide arm 70. In this case, use of protrusions 130 and/or stoppers 80 may be unnecessary in order to self-adjust vanes 30 in bidirectional fan 10.

It is understood that bidirectional fan 10 may be rotated from an engaged clockwise rotation position, to a neutral position, to an engaged anti-clockwise rotation position, without the need to manually adjust vanes 30. That is, vanes 30 may be adjusted from clock-wise leaning, to neutral, to anti-clockwise leaning simply by rotating a drive shaft (not shown) connected to apertures 60.

Figure 10:
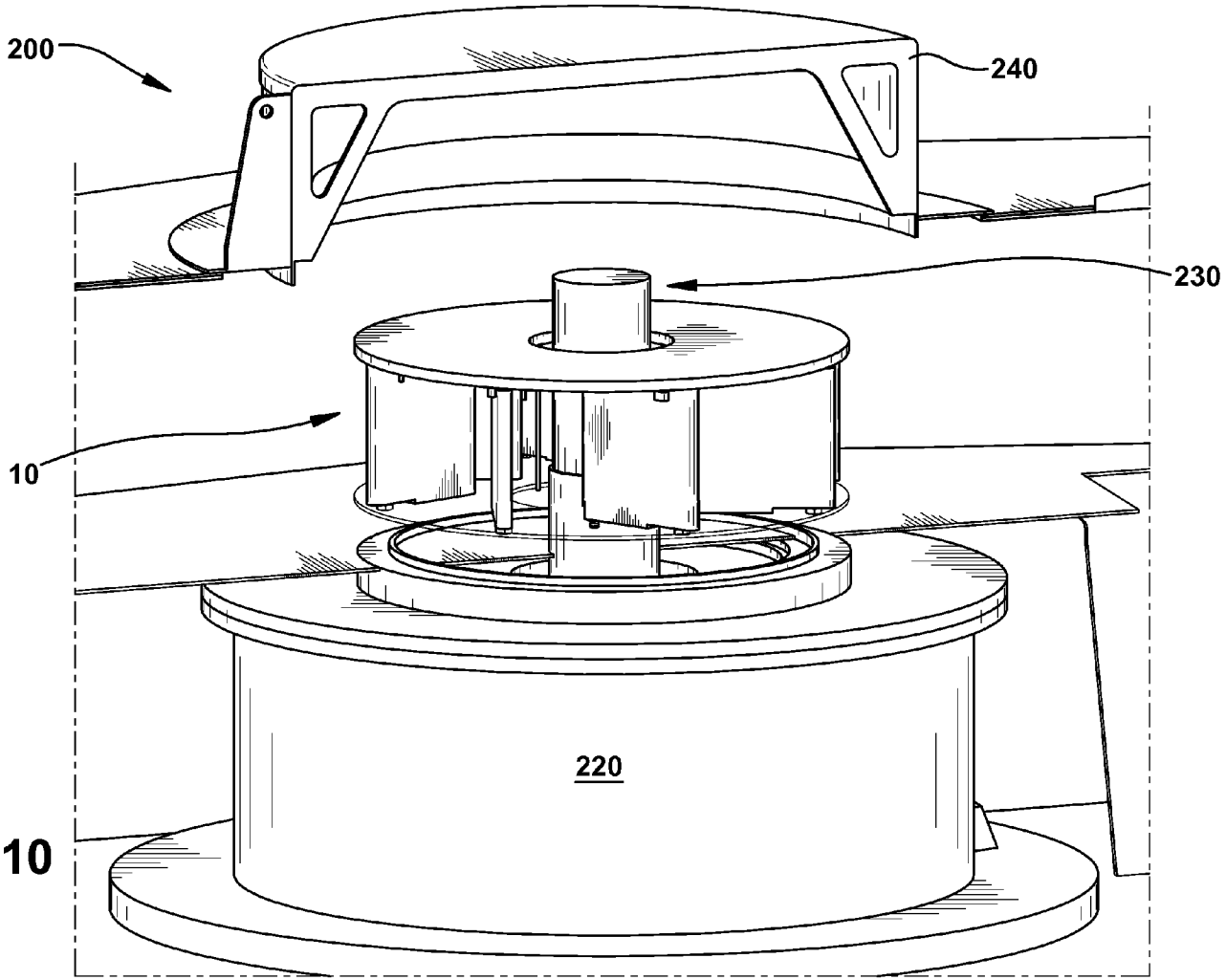
FIG. 10 shows a partial cut-away view of a motor assembly including a bidirectional fan according to embodiments.

Turning to FIG. 10, a cut-away view of a motor assembly 200 including bidirectional fan 10 is shown according to an embodiment. As shown, bidirectional fan 10 may be coupled to a motor body 220 via a shaft 230. Operation of motor assembly 200 is omitted for brevity, but motor assembly 200 (including motor body 220) may function as any conventional motor assembly configured to drive a flow creating device (e.g., a fan or impeller or pump).

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A bi-directional centrifugal fan including:
a driving disc having a pivot pin extending therefrom,
wherein the pivot pin is fixed to the driving disc;
a vane pivotably attached to the pivot pin, the vane including an aperture extending at least partially therethrough; and
a trailing disc including a guide arm for receiving the aperture of the vane,
wherein the guide arm is fixed to the trailing disc,
wherein the trailing disc has a greater weight than the driving disc.

2. The fan of claim 1, wherein the pivot pin extends substantially perpendicularly from the driving disc.

3. The fan of claim 1, further comprising support arms extending from the trailing disc for providing radial support between the trailing disc and the driving disc.

4. The fan of claim 1, the trailing disc further comprising:
a first stopper adjacent the guide arm; and
a second stopper adjacent the guide arm on a distinct side of the vane from the first stopper.

5. The fan of claim 4, wherein the first stopper and the second stopper are equally spaced from the guide arm on opposing sides of the guide arm.

6. The fan of claim 5, wherein the vane includes a protrusion extending therefrom, the protrusion configured to engage one of the first stopper or the second stopper.

7. The fan of claim 6, wherein the protrusion includes a guideway configured to engage the one of the first stopper or the second stopper by at least partially surrounding the one of the first stopper or the second stopper.

8. The fan of claim 7, the at least one vane including a guideway extending therefrom, the guideway configured to engage and disengage one of the first stopper or the second stopper in response to a lag in rotation of the trailing disc with respect to the driving disc.

9. The fan of claim 1, wherein the vane is configured to move with respect to the guide arm along a primary axis of the vane.

10. The fan of claim 1, wherein an end of the pivot pin is configured to receive a stopper, the stopper restricting movement of the vane along an axis of rotation of the driving disc.

11. The fan of claim 1, wherein the aperture is located radially outwardly of the pivot pin.

12. An apparatus comprising:

a motor; and a bidirectional fan operably connected to the motor, the bidirectional fan including:

a driving disc including a pivot pin extending therefrom;

a vane pivotably attached to the pivot pin, the vane including an aperture extending at least partially therethrough, wherein the aperture is located radially outwardly of the pivot pin; and a trailing disc including a guide arm for receiving the aperture of the vane, the guide arm configured to move along a length of the aperture, wherein the trailing disc has a greater weight than the driving disc.

13. The apparatus of claim 12, wherein the bidirectional fan includes a centrifugal fan.

14. The apparatus of claim 12, wherein the trailing disc further includes:

a first stopper adjacent the guide arm; and a second stopper adjacent the guide arm on a distinct side of the vane from the first stopper; and wherein the vane includes a protrusion extending therefrom, the protrusion configured to engage one of the first stopper or the second stopper.

15. The apparatus of claim 12, wherein the aperture includes a slot extending along a primary axis of the at least one vane, the slot having a length along the primary axis greater than a diameter of the guide arm.

16. A bi-directional centrifugal fan including:

a driving disc having a plurality of pivot pins extending therefrom;

a plurality of vanes each pivotably attached to one of the plurality of pivot pins, each of the plurality of vanes including a slot extending along a primary axis of the vane and at least partially therethrough along a secondary axis of the vane; and a trailing disc including:

a guide arm for receiving the slot of the vane, the guide arm configured to move within the slot along the primary axis of the vane, wherein the trailing disc has a greater weight than the driving disc.

17. The fan of claim 16, wherein the trailing disc further includes:

a first stopper adjacent the guide arm; and a second stopper adjacent the guide arm on a distinct side of the vane from the first stopper; and wherein the vane includes a protrusion extending therefrom, the protrusion configured to engage one of the first stopper or the second stopper.

* * * * *